US007682172B2

(12) United States Patent
Lu

(10) Patent No.: US 7,682,172 B2
(45) Date of Patent: Mar. 23, 2010

(54) ELECTRICAL CONNECTOR ASSEMBLY WITH ESD PROTECTION

(75) Inventor: Yao-Pang Lu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/315,036

(22) Filed: Nov. 26, 2008

(65) Prior Publication Data

US 2009/0142946 A1 Jun. 4, 2009

(30) Foreign Application Priority Data

Nov. 29, 2007 (CN) ..... 2007 2 0041762 U
Nov. 29, 2007 (CN) ..... 2007 2 0041786 U

(51) Int. Cl.
*H01R 13/53* (2006.01)

(52) U.S. Cl. ..... 439/181; 439/607; 439/620.13

(58) Field of Classification Search ..... 439/71, 439/620.09, 620.13, 620.24, 181
See application file for complete search history.

(56) References Cited

U.S. PATENT DOCUMENTS

| | | | | |
|---|---|---|---|---|
| 7,018,242 | B2 * | 3/2006 | Brown et al. | 439/676 |
| 7,172,431 | B2 * | 2/2007 | Beaman et al. | 439/71 |
| 2002/0042223 | A1 * | 4/2002 | Belopolsky et al. | 439/541.5 |
| 2005/0197006 | A1 * | 9/2005 | Blichasz et al. | 439/541.5 |

* cited by examiner

*Primary Examiner*—Briggitte R Hammond
(74) *Attorney, Agent, or Firm*—Ming Chieh Chang; Wei Te Chung; Andrew C. Cheng

(57) ABSTRACT

An electrical connector assembly in accordance with a preferred embodiment of the present invention is provided. The electrical connector assembly comprises an insulative housing in which a plurality of contacts retained. The contacts include a plurality of signal contacts and at least one grounding contact. Furthermore, the electrical connector assembly includes an electrostatic discharge device which electrically interconnected with the contact.

13 Claims, 12 Drawing Sheets

ELECTRICAL CONNECTOR ASSEMBLY WITH ESD PROTECTION

REFERENCE OF RELATED APPLICATION

This application is related to U.S. patent application Ser. No. 12/218,753, entitled "Electrical Connector", filed on Jul. 16, 2008.

BACKGROUND OF THE INVENTION

1. Field of the Invention

The present invention relates to an electrical connector assembly, and more particularly to an electrical connector assembly incorporated with an electrostatic discharge (ESD) protection. Said electrical connector assembly features a plurality terminal contacts on which the ESD protection device is supported and electrically interconnected with the terminal contacts thereby protecting a printed circuit board on which the electrical connector assembly is mounted.

2. Description of the Related Art

USB (Universal serial bus) has been widely used and adopted by computer industry even since it is developed and marked because of its simplicity, convenience, and efficiency. A variation or reduced sized USB, generally referred to mUSB (Micro USB) is later used in many kinds of consumer electronics, particularly such as PDA (Personal Digital Assistants), digital cameras, mobile phones, etc.

With the development of society and improvement demands of consumer, the function of mobile phone becomes more and more versatile. For example, the modern mobile phone is a combination of MP3, digital cameras, PDAs, and even GPS. Inevitably, data transmission between the mobile phone and a computer become more and more frequently.

In order to download and upload data from a mobile phone to the computer, a USB cable assembly is widely used, and which generally includes a standardized USB 2.0 at one end for the computer end, and a mUSB at the other end for interconnection with the mobile phone. As long as there is a connection to the mobile phone, there is a potential risk of damaging the electronic components within the mobile phone because of accidental electrostatic discharge which will surge into the mobile phone through the interconnection between the mobile phone and the computer. Therefore, there is a risk that an electrostatic discharge can be generated when the mUSB is mating with the exterior equipment thereby damaging the electrical component within the mobile phone, for example, electronic components mounted onto a printed circuit board of the mobile phone.

Chinese Patent No. CN 2579029 discloses an electrical connector mounted onto a printed circuit board. Said electrical connector includes at least an insulative housing, a plurality of contacts received into the housing, and a cover mounted onto the housing. Each contact includes a base portion retained into the housing, a contact engaging portion in order to contact with a contact of a mating connector, and a tail portion in order to connect with a first soldering pad formed on the printed circuit board. The cover at least includes a top plate and two opposite side plates in order to surround a top and two opposite side portions of the insulative housing. And the electrical connector further comprises a spring member assembled onto the housing. The spring member comprises a main portion, a coping portion and a bottom portion, wherein the coping portion and the bottom portion separately disposed on two ends of the main portion and parallel to each other. After the electrical connector assembled, the coping portion of the spring member is contacted with the top plate of the cover and the bottom portion is contacted with a second soldering pad formed on the printed circuit board. Meanwhile, the printed circuit board further includes an electrical element and a related circuit, wherein the electrical element can selective and electrically connect with the contacts. An input of the electrical element is electrically connected to the tail portion of the contact by the related circuit and an output of the electrical element is electrically connected to a grounding circuit. And the second soldering pad is electrically connecting to the grounding circuit through the printed circuit. Therefore, when the electrical connector is mating with the mating connector and an electrostatic discharge is generated, the electrical element will break through a critical voltage and electrically connect with the contact such that the excess-voltage is removed by connecting with the grounding circuit by the electrical element and protect the electrical member mounted onto the printed circuit board.

BRIEF SUMMARY OF THE INVENTION

It is an object of the present invention to provide an electrical connector assembly incorporated with an ESD protection so as to protecting a printed circuit board.

The present invention provides an electrical connector assembly includes an insulative housing, a plurality of contacts retained in the insulative housing, a shell enclosing the insulative housing, and an electrostatic discharge device electrically and mechanically connecting with the contacts. The insulative housing has a base portion and a tongue portion extending from the base portion forwardly. Each contact comprises a contacting end received in the tongue portion, a connecting portion secured in the base portion, and a tail portion extending rearwards from the connecting portion. The shell defines a rear plate. The tail portion defines a distal end confronting the rear plate of the shell and the electrostatic discharge device is housed between the rear plate and corresponding distal ends.

In order to achieve the objective above, another electrical connector assembly in accordance with a preferred embodiment of the present invention is provided. The electrical connector assembly comprises a housing having a mating portion and a vertical rear wall annexed to the mating portion and a plurality of contacts assembled into the housing. The contact includes a plurality of signal contacts and at least a grounding contact, each of the signal contacts and the grounding contact including a horizontal contact engaging portion disposed on the mating portion of the housing and a horizontal tail portion extending outwardly from a bottom face of the housing and vertical to the rear wall of the housing. Overmore, the electrical connector assembly further includes an electrostatic discharge device arranged between the rear wall of the housing and the tail portion of the contacts and interconnection with the contacts.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like members in the figures and in which:

DESCRIPTION OF PREFERRED EMBODIMENT OF THE INVENTION

In the following detailed description, for purposes of explanation, numerous specific details are set forth in order to provide a thorough understanding of the present invention.

Please refer to FIG. 1 to FIG. 6, the electrical connector assembly according to the first embodiment of present invention comprises an insulative housing 1, a plurality of contacts 2 retained in the insulative housing 1, a shielding shell 3 enclosing the insulative housing 1, and an IC (Integrated Circuit) member 4 mounted onto the insulative housing 1.

Figure 2:
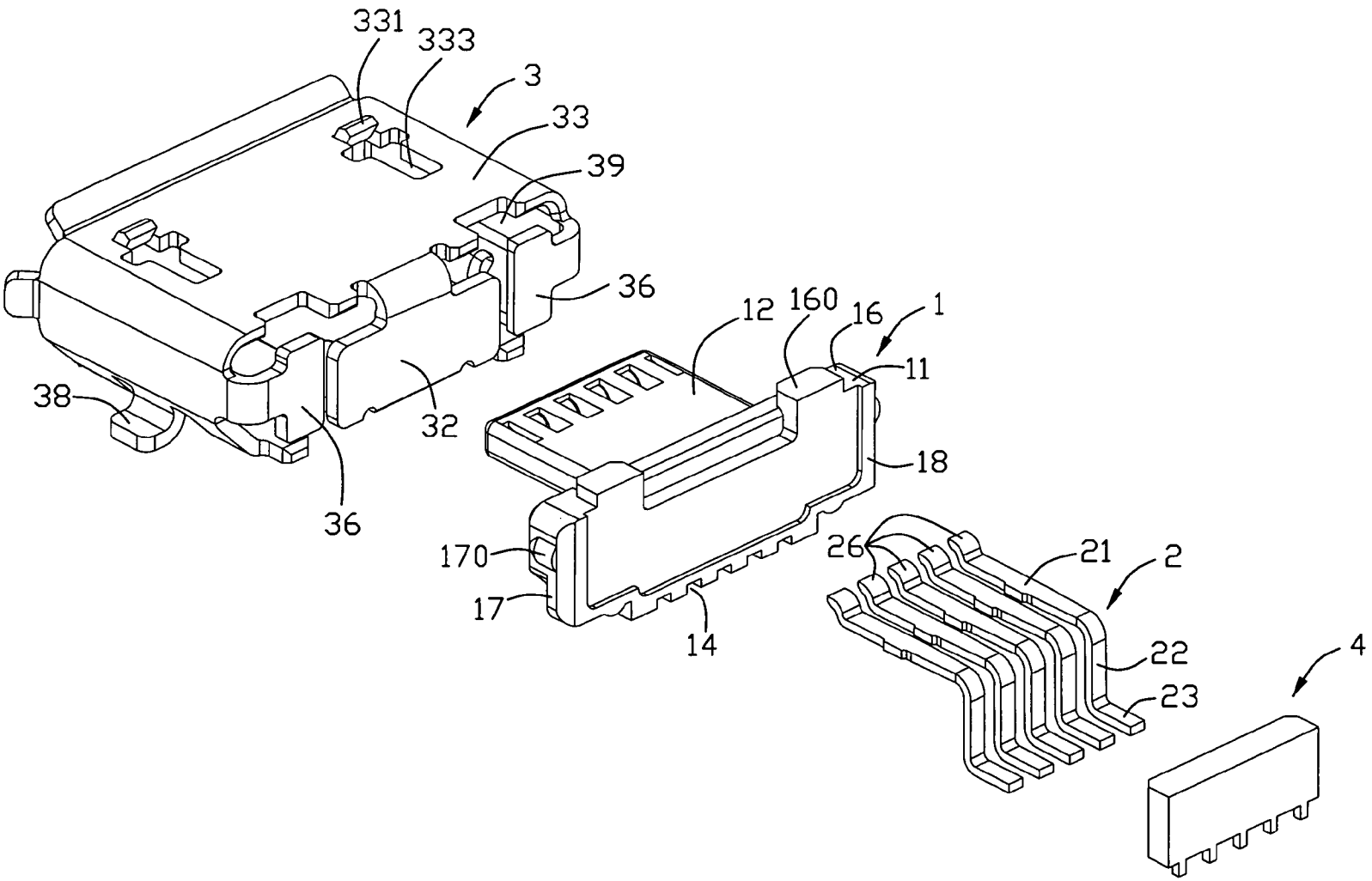
FIG. 2 is an exploded view of the electrical connector assembly of FIG. 1.
Figure 3:
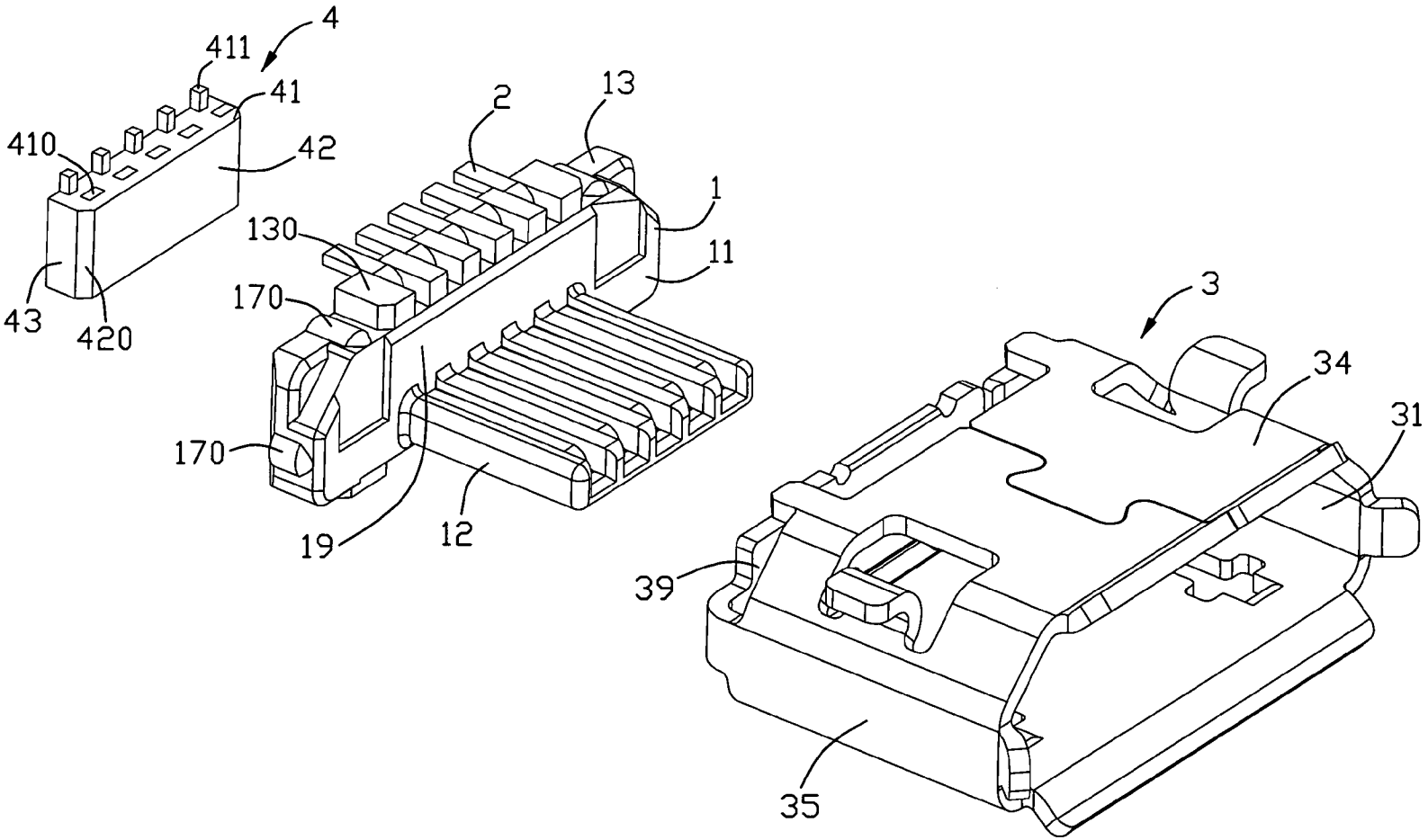
FIG. 3 is similar to FIG. 2, while the contacts have assembled into the housing.
Figure 4:
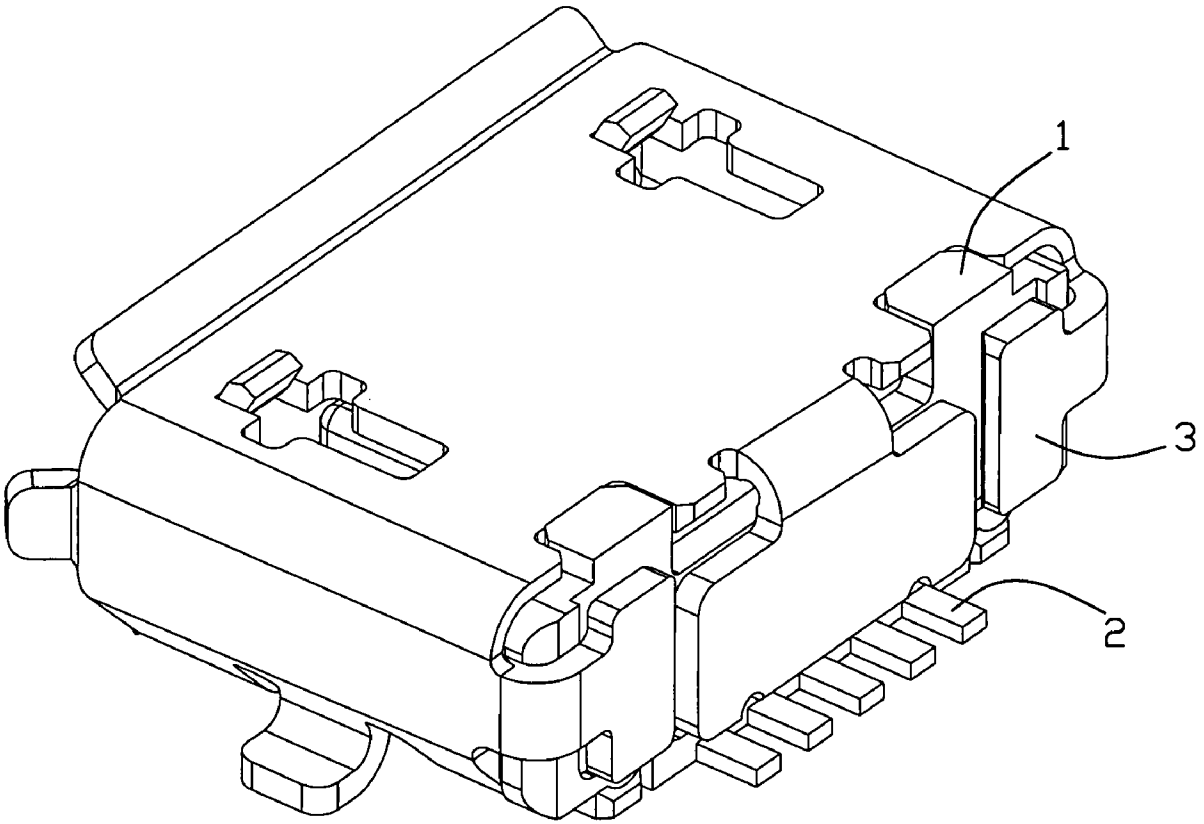
FIG. 4 is a perspective view of an electrical connector of FIG. 1, while the IC member is not assembled onto the electrical connector.
Figure 5:
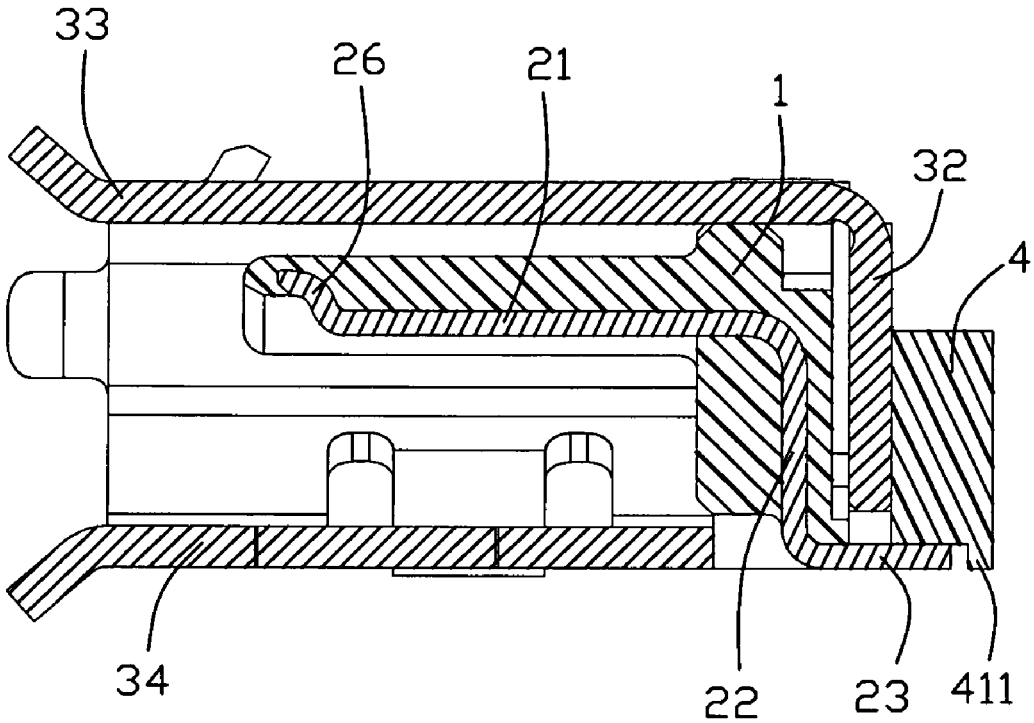
FIG. 5 is a cut view of FIG. 1 along a line 5-5.
Figure 6:
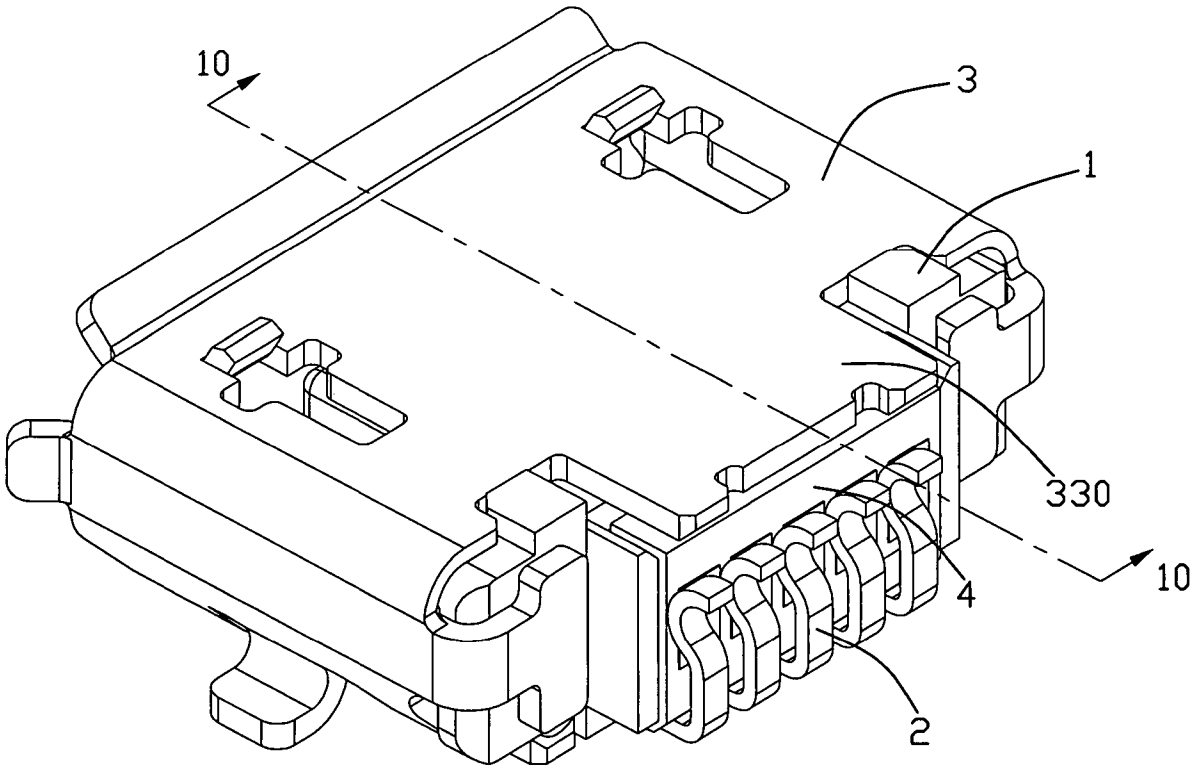
FIG. 6 is a perspective view of an electrical connector assembly according to the second embodiment of the present invention.

Please particular refer to FIGS. 2-3, the insulative housing 1 includes a base portion 11 and a tongue portion 12 extending forwardly along a front-to-back direction, wherein the length of the base portion 11 along a left-to-right direction is longer than that of the tongue portion 12. The base portion 11 includes a front surface 19, a rear surface 18, a top surface 16, a bottom surface 13 and two opposite side surfaces 17. A plurality of terminal passageways 14 are defined on the insulative housing 1, each passageway 14 extending along the front-to-back direction on the tongue portion 12 and penetrating the bottom face 13 of the base portion 11. A plurality of first blocks 130 are defined on the top face 13 of the base portion 11 and a pair of second blocks 160 are defined on two ends of the bottom face 16 of the base portion 11. A clearance between adjacent the first blocks 130 is penetrated with the terminal passageways 14. Meanwhile, each of the side surface 17 and bottom surface 13 defines at least a protrusion 170 to engage with an inner surface of the shielding shell 3.

The contacts 2 are retained into the terminal passageways 14 of the insulative housing 1, each including a horizontal retention portion 21 extending along the front-to-back direction, a solder portion 23 horizontally extending from one end of the retention portion 21, a vertical portion 22 disposed between the retention portion 21 and the solder portion 23, and a contact engaging portion 26 extending from the other end of the retention portion 21 adapted for engaging with a contact of mating connector. Wherein the retention portion 21 defines a plurality of barbs (not shown) adapted for engaging with an inner surface of the insulative housing 1. Additionally, in this embodiment, there have five contacts 3 in all, wherein one is a grounding contact and other four is signal contacts.

The shielding shell 3, made of metal material, enclosing the insulative housing 1, comprises a top plate 33, a bottom plate 34, and two opposite side plates 35. A first and second holding section 32, 36 are formed on the shielding shell 3. The first holding section 32 is bent downwardly from a rear edge of the top plate 33, and the second holding section 36 is bent from a rear edge of the side plate 35 to opposite side plate 35. As a result, the top plate 33, the bottom plate 34, the side plates 35, and the first and second holding section 32, 36, commonly defines a receiving room 31 in which the insulative housing 1 is received. The top plate 33 defines a substantially cross-shaped groove 333 penetrating the top plate 33 along a top-to-down direction. At least a spring portion 331 is formed on an edge of the groove 333 and extends slantly and upwardly adapted for engaging with a mating connector. Additionally, a pair of cut portions 39 are formed on rear edges of the top plate 33 and dispose on two sides of the first holding section 32 in order to engage with insulating housing 1. And a distance (not shown) is formed between inner surfaces of the first and second holding section 32, 36 and a rear end of the top plate 32 and bottom plate 34 such that the insulating housing 1 is retained firmly in the receiving room 31. The side plate 35 defines a pair of solder pads 38, each extending horizontally from a middle section of outsurface thereof to outside.

Figure 1:
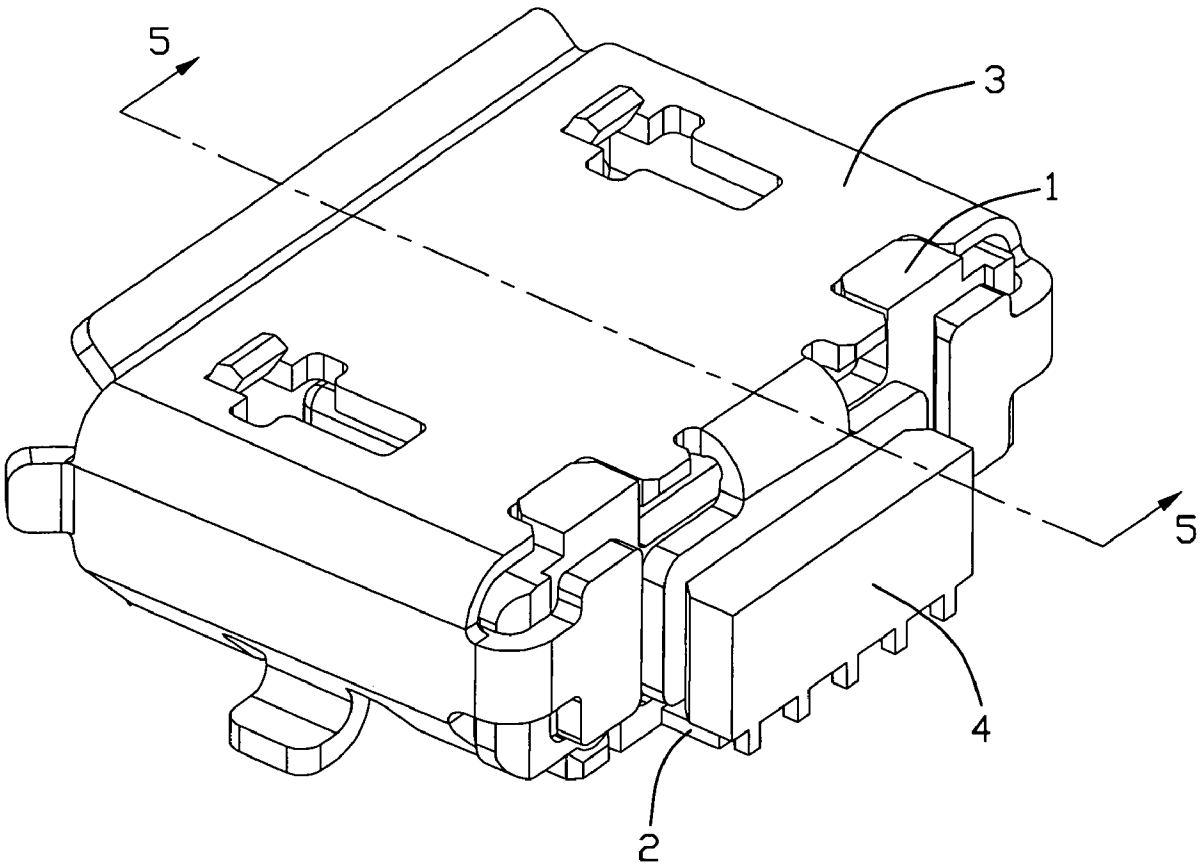
FIG. 1 is a perspective view of an electrical connector assembly according to the first embodiment of the present invention.

Following, please also refer to FIGS. 2-3 and joint to FIG. 1, the IC (Integrated Circuit) member 4 is compress and congregate at least an ESD protection member. Please particularly refer to FIGS. 1 and 6, it is attached to outsurface of the first holding section 32 and connect with the solder portions 23 of the contacts 2. The IC member 4 at least includes an engaging surface 42 contacting to the first holding section 32, a bottom surface 41 connecting with the solder portion 23 of the contacts 2 and two opposite side surface 43 adjacent and vertical to the bottom surface 41 and the engaging surface 42. Wherein, the bottom surface 41 defines a plurality of conductive regions 410 corresponding to the solder portions 23 of the contacts 2 and a plurality of post portions 411 adapted for mounted on the printed circuit board. Furthermore, a slant surface 420 is formed on an intersection position between the engaging surface 42 and the side surface 43.

Please also refer to FIGS. 1-6, when assembly, firstly, the contacts 2 are assembled into the terminal passageways 14 of the insulative housing 1, separately, with the solder portion 23 extending outside from the bottom surface 13 of the insulative housing land the contact engaging portion 26 exposured into the receiving room 31 of the shielding shell 3 so as to engage with the contact of mating connector; secondly, the shielding shell 3 encloses the insulative housing 1 with the first and second holding sections 32, 36 separately abut the rear surface 18 of the insulative housing 1, and the first and second blocks 160 receiving into the corresponding cut portion 39 of the shielding shell 3, at this moment, the solder pads 38 formed on the shielding shell 3 are coplanar with the solder portions 23 of the contacts 2; finally, the IC member 4 is attaching to the rear surface 18 by laying colloid on the rear surface 18 of the insulative housing 1, meanwhile the conductive region 410 of the IC member 4 contacted with the solder portions 23 of the contact 2.

When said electrical connector assembly is mounted onto the printed circuit board, the solder portions 23 of the contact 2, the solder pads 38 of the shielding shell 3, and the post portions 411 of the IC member 4 are connected with the corresponding conductive pads formed on the printed circuit board. Because the ESD protection is congregated into the IC member 4, it is not necessary that the printed circuit board defines an extra ESD protection. When an excess-current passes through the signal contact 2, the excess-current is discharged to the grounding contact via the IC member 4 so as to prevent the excess-current damaging the other electrical member mounted onto the printed circuit board.

Please refer to FIGS. 6-9, the electrical connector assembly according to the second embodiment of present invention comprises an insulative housing 1, a plurality of contacts 2 retained into the insulative housing 1, a shielding shell 3 enclosing the insulative housing 1, and an IC member 4 mounted on the insulative housing 1.

Herein, the differences between the first and second embodiment are only described as following. Each contact 2 includes a first contact engaging portion 21 adapted for engaging with a contact of mating connector, a vertical retention portion (not shown) retained into the base portion 11 of the insulative housing 1, a solder portion 23 extending horizontally and rearwardly from one end of the retention portion, a bend portion 24 extending upwardly from a distal end of the solder portion 23. The bend portion 24 defines a second contact engaging portion 25 protruding towards the retention portion and adapted to contact with conductive pads 410 formed on the IC member 4. Therefore, there has a distance between the bend portion 24 of the contact 2 and the rear surface 18 of the insulative housing 1. Moreover, the rear surface 18 of the insulative housing 1 defines two opposite side plate 180, thereby the rear surface 18, the two opposite side plates 180, the solder portions 23 and the bend portions 24 of the contact 2 commonly defines a receptor 182 in which the IC member 4 is received. Additionally, the shielding shell 3 defines a board portion 330 extending horizontally and rearwardly from a rear edge of the top plate 33 of the shielding shell 3.

Figure 7:
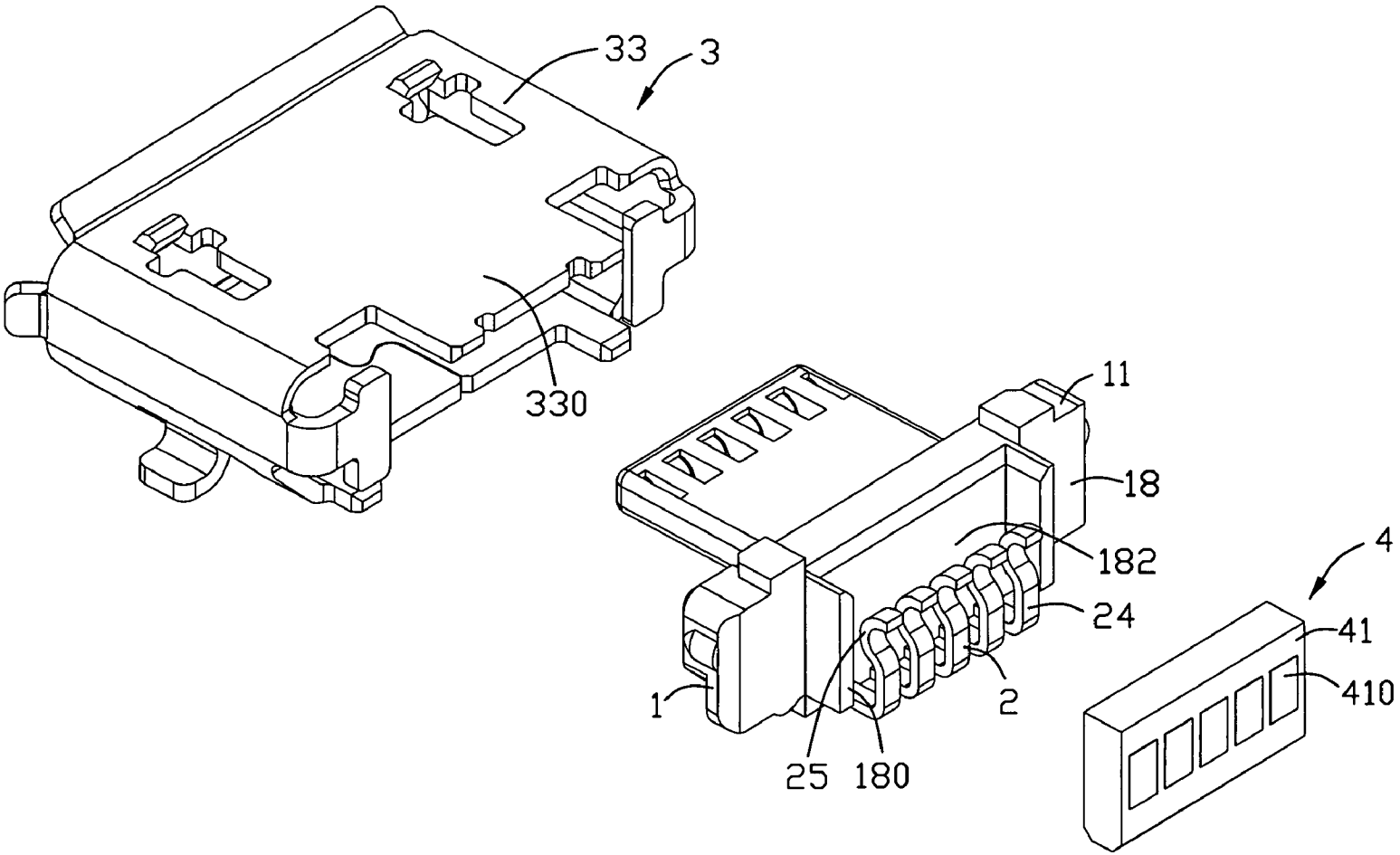
FIG. 7 is an exploded view of the electrical connector assembly of FIG. 6.
Figure 8:
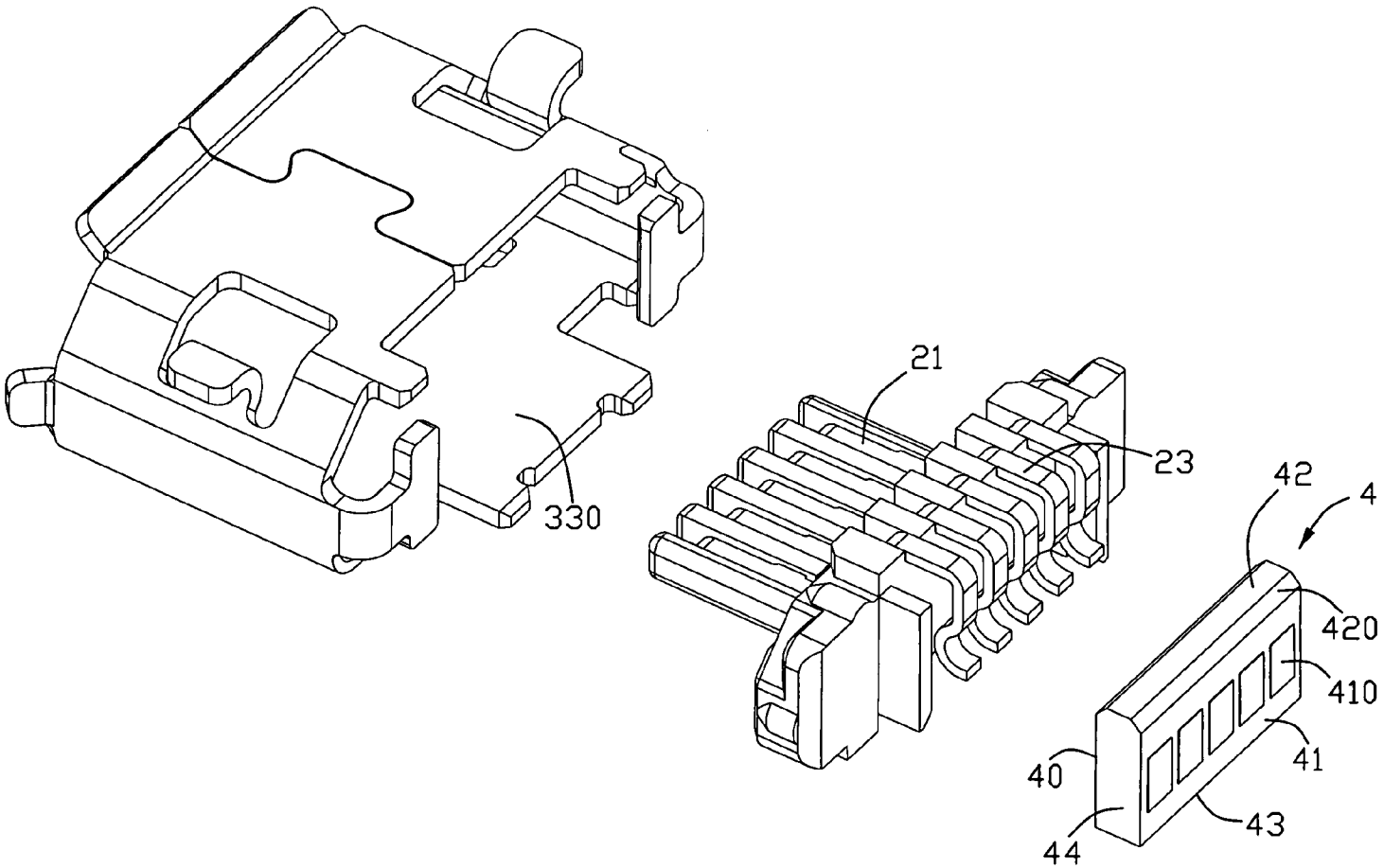
FIG. 8 is another exploded view of the electrical connector assembly of FIG. 6.
Figure 9:
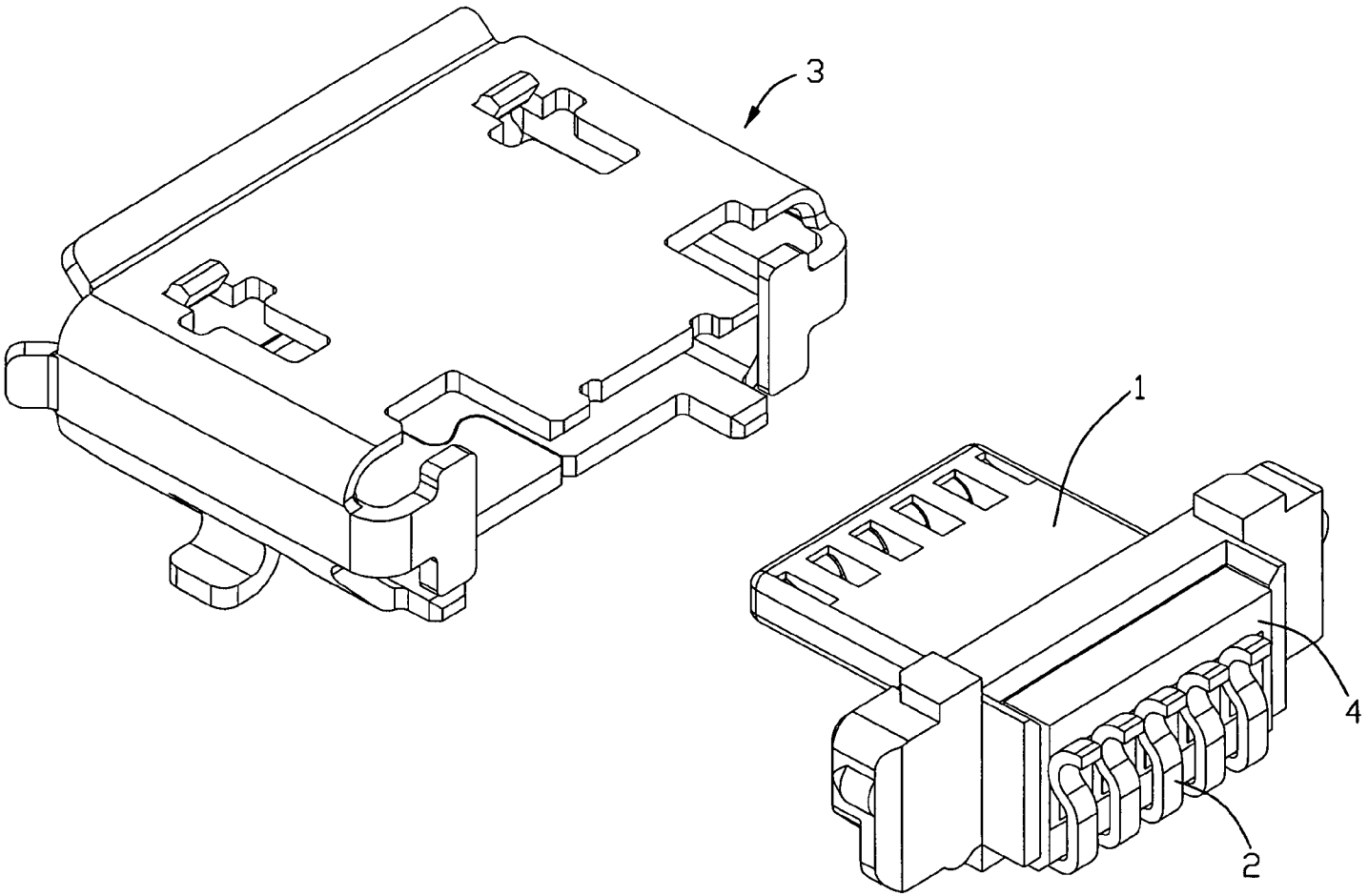
FIG. 9 is a partly perspective view of an electrical connector assembly of FIG. 6, wherein the shell has not mounted onto the housing.

Please particular to refer to FIGS. 7-8, the IC member 4 includes a top face 42, a bottom face 43, two opposite side faces 44, and two opposite first and second engaging faces 40, 41. Wherein, the second engaging face 41 defines a plurality of conductive pads 410 corresponding to the second contact engaging portion 25 of the contact 2.

When said electrical connector assembly have completely assembled, the IC member 4 is received into the receptor 182 with the first engaging face 40 of the IC member 4 abut the rear surface 18 of the insulative housing 1, the second engaging face 41 electrically contacting with the second contact engaging portions 25 of the contacts 2, the bottom face 43 abut the solder portions 23 of the contact 2, and the top face 42 abut an bottom surface of the board portion 330 of the shielding shell 3.

Figure 10:
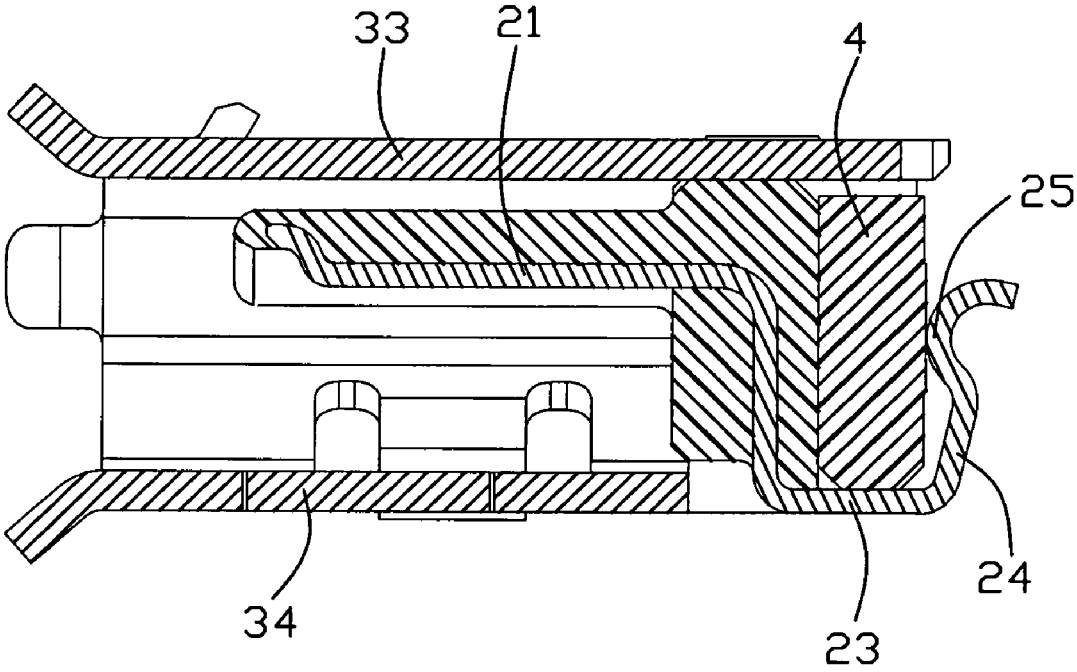
FIG. 10 is a cut view of FIG. 6 along a line 10-10.
Figure 11:
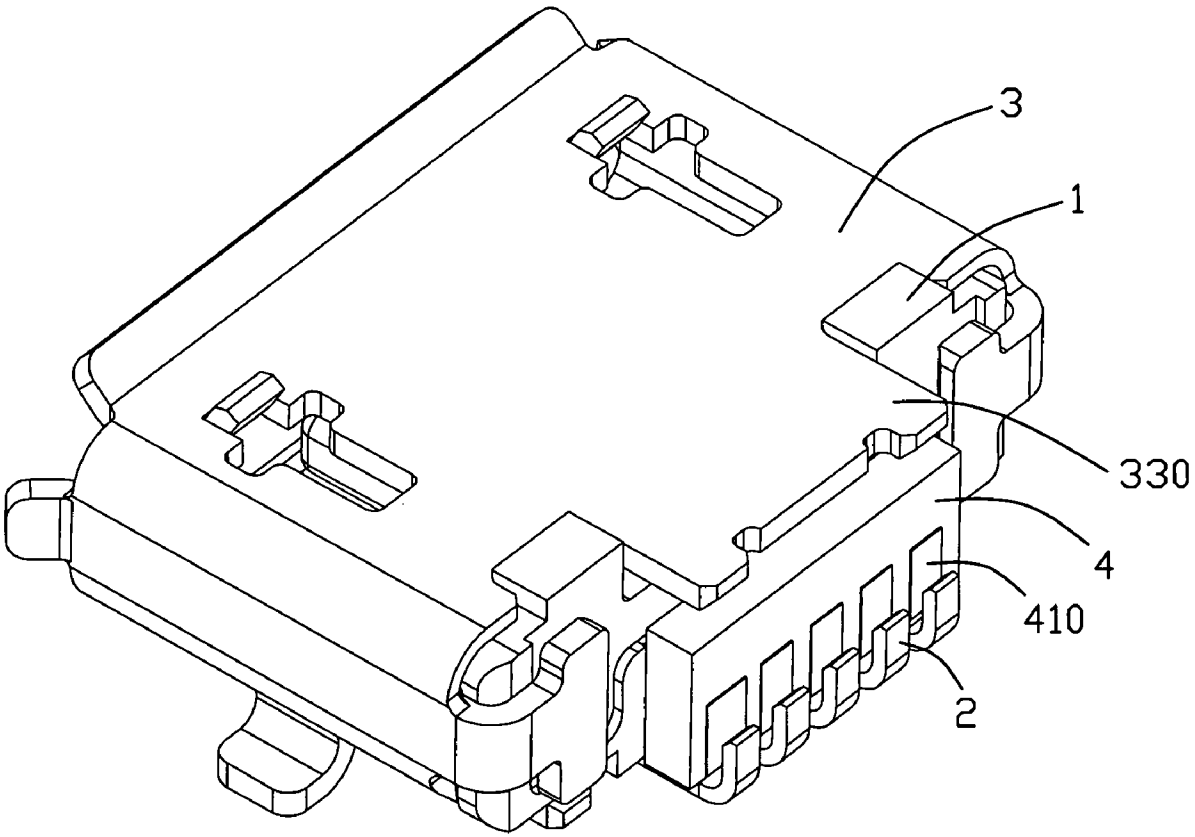
FIG. 11 is a perspective view of an electrical connector assembly according to the third embodiment of the present invention.
Figure 12:
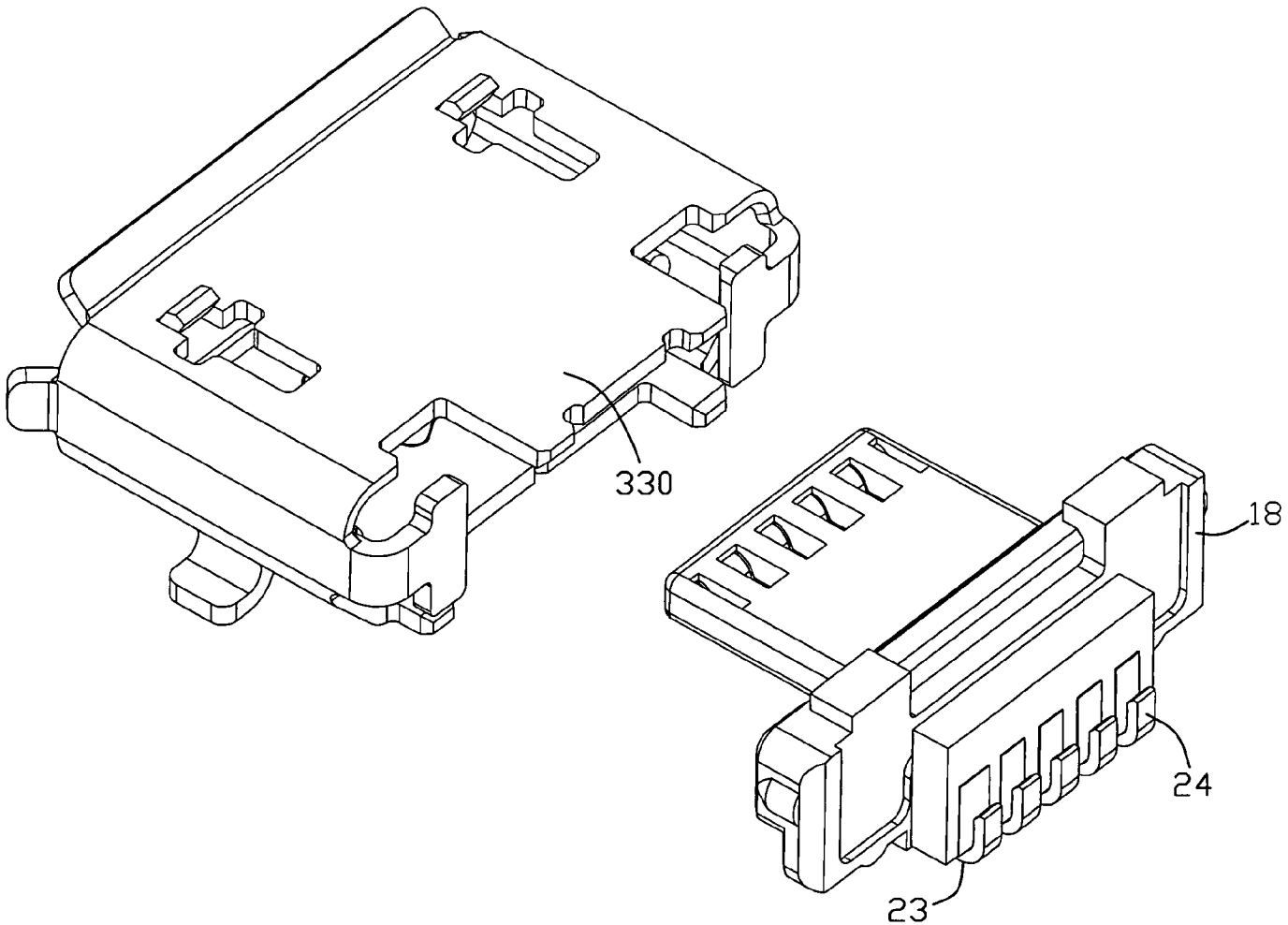
FIG. 12 is partly perspective view of the electrical connector assembly of the FIG. 11.

Please refer to FIGS. 10-11, the electrical connector assembly according to the third embodiment of present invention is similar to the electrical connector assembly according to the second embodiment, the only difference therebetween is that the receptor (not shown) for receiving the IC member 4 is formed by the rear surface 18 of the insulative housing 1, the solder portions 23 of the contacts 2 , the bend portions 24 of the contact portions 2, and the board portion 330 of the shielding shell 3, and not have the side plates 180 extending rearwardly from the rear surface 18 of the insulative housing 1.

In the above description of the preferred embodiment, the terminal includes a plurality of signal contacts and at least a grounding contact. And an IC member is attaching to the electrical connector and electrical interconnected with the terminal contacts. Therefore, when the electrical connector assembly has completely assembled, all the terminal contacts has connected with the IC member, thereby during a spark is happening, an excess-current coming from the signal contact is transferred to the grounding contact via the IC member so as to protect the printed circuit board damaging by the excess-current.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector assembly comprising:

an insulative housing having a base portion and a tongue portion extending from the base portion forwardly;

a plurality of contacts retained in the insulative housing, each contact comprising a contacting end received in the tongue portion, a connecting portion secured in the base portion, and a tail portion extending rearwards from the connecting portion;

a shell enclosing the insulative housing and defining a rear plate; and an electrostatic discharge device electrically and mechanically connecting with the contacts;

wherein said tail portion defines a distal end confronting the rear plate of the shell and the electrostatic discharge device is housed between the rear plate and corresponding distal ends.

2. The electrical connector assembly as recited in claim 1, wherein the electrostatic discharge device includes a first surface having a grounding trace and a second surface having a plurality of conductive pads.

3. The electrical connector assembly as recited in claim 2, wherein the rear plate of the shell mechanically and electrically connects to the first surface of the electrostatic discharge device and the contacts mechanically and electrically connect to the conductive pads.

4. The electrical connector assembly as recited in claim 3, said first surface of the electrostatic discharge device is perpendicular to the second surface of the electrostatic discharge device.

5. The electrical connector assembly as recited in claim 3, wherein said first surface of the electrostatic discharge device is parallel to said second surface of the electrostatic discharge device.

6. An electrical connector assembly comprising:

a housing having a mating portion and a vertical rear wall annexed to the mating portion;

a plurality of contacts assembled into the housing and including a plurality of signal contact and at least one grounding contact;

each of the signal contacts and the grounding contact including a horizontally contact engaging portion disposed on the mating portion of the housing, and a horizontally tail portion extending outwardly from a bottom face of the rear wall of the housing and vertical to the rear wall of the housing; and an electrostatic discharge device arranged between the rear wall of the housing and the tail portion of the contacts and interconnected with the contacts, the electrostatic discharge having a bottom surface, said bottom surface defining a plurality of electrical pads interconnecting with the tail portions of the contacts and a plurality of posts protruding beyond the tail portions of the contacts and adjacent to the electrical pads.

7. The electrical connector assembly as recited in claim 6, wherein the tail portion of the contact extends beyond an rear edge of the rear wall of the housing and a bend portion is formed on the tail portion and extends upwardly from a distal end of the tail portion, wherein there has a distance between the bend portion and the rear wall of the housing.

8. The electrical connector assembly as recited in claim 7, wherein the housing further defines two opposite side plates extending rearwardly from the rear wall thereof and commonly defines a receiving space with the rear wall of the housing, the tail portion of the contacts and the bend portion of the contacts.

9. The electrical connector assembly as recited in claim 8, wherein the bend portion firstly extends upwardly, then protrudes towards the receiving space, and finally protruding outwardly.

10. An electrical connector assembly comprising:

an insulative housing defining a rear face;

a metallic shell enclosing said housing;

a plurality of contacts disposed in the housing, each of said contacts defining a solder section extending out of the rear face with thereon opposite upper and bottom surfaces engaged with an IC member and a printed circuit board, respectively; and said IC member seated upon the upper surface and exposed to an exterior behind the rear face; wherein said IC member defines a plurality of conductive pads respectively engaged with the upper surfaces of the solder sections of the corresponding contacts, respectively.

11. The electrical connector assembly as claimed in claim 10, wherein the shell includes a rear plate covering the rear face, and said IC member abuts against an exterior face of said rear plate.

12. The electrical connector assembly as claimed in claim 10, wherein said IC member is secured on a back side of the connector via adhesives.

13. The electrical connector assembly as claimed in claim 10, wherein said IC member is secured on a back side of the connector via abutment sections extending from the corresponding solder sections upwardly.

* * * * *